United States Patent [19]

Duncan et al.

[11] 4,331,267

[45] May 25, 1982

[54] CAULKING TUBE PLUNGER AND ENCLOSURE ASSEMBLY

[75] Inventors: Gail F. Duncan; Emerson F. Browning; Karl Rotterman, all of Dayton, Ohio

[73] Assignee: Tri-Made Products, Inc., Dayton, Ohio

[21] Appl. No.: 178,648

[22] Filed: Aug. 15, 1980

[51] Int. Cl.[3] ..... B65D 47/04; B65D 83/00

[52] U.S. Cl. ..... 222/153; 222/327; 222/326

[58] Field of Search ..... 222/80, 153, 326, 327, 222/386, 386.5

[56] References Cited

U.S. PATENT DOCUMENTS

| | | | |
|---|---|---|---|
| 2,649,999 | 8/1953 | Burcit | 222/327 X |
| 2,941,699 | 6/1960 | Schmidt et al. | 222/327 |
| 3,162,337 | 12/1964 | Sabaka . | |
| 3,211,347 | 10/1965 | Phillips . | |
| 3,319,841 | 5/1967 | Berg . | |
| 3,815,791 | 6/1974 | Clark | 222/326 |
| 3,880,331 | 4/1975 | Perkins . | |
| 4,027,810 | 6/1977 | Van Manen | 222/327 |

*Primary Examiner*—Robert J. Spar
*Assistant Examiner*—Frederick R. Handren
*Attorney, Agent, or Firm*—Biebel, French & Nauman

[57] ABSTRACT

A combined caulking tube plunger and enclosure assembly is disclosed which includes a single piece of drawn metal in generally a cup-shaped configuration including a bottom wall, a circular or annular side wall which forms a close fit with the inside diameter of a caulking tube and which provides guidance of the plunger portion through the caulking tube, and an outer rim which is adapted to be rolled over the outer end of a caulking tube to form a closure and seal therewith. A circumferential break-away score or dart is formed in the side wall axially inwardly of the rim which causes the major portion of the side wall and the bottom wall, forming a plunger, to be broken away from the rim upon the application of force by the ram of a caulking gun thus to separate the plunger portion from the rim portion.

5 Claims, 5 Drawing Figures

CAULKING TUBE PLUNGER AND ENCLOSURE ASSEMBLY

BACKGROUND OF THE INVENTION

This invention relates to a combined caulking tube plunger and enclosure assembly, and, more particularly it relates to a unitary piece having a break-away plunger formed integrally with the enclosure portion.

Closures for caulking gun tubes are commonly formed in two pieces, including an outer rim which engages the end of the tube, and a separate plunger received in sealing relation to the rim, which plunger is engageable by the caulking gun ram to move through the tube. Such two part rim or ring plunger assemblies are relatively costly to make and use. First, they employ or require two manufacturing operations since the ring and plunger are made from separate parts, and there is commonly a waste area created by the manufacture of the ring or rim. Further, these parts must be separately inserted within or secured to the caulking tube.

See, for example, the patent of Perkins, U.S. Pat. No. 3,880,331, issued Apr. 29, 1975. In perkins there is disclosed a tube strengthening closure rim or ring in association with a plunger. However, the plunger and ring are associated together as separate parts and the plunger is initially frictionally gripped by the ring for movement away from the ring by compressed air applied to the plunger. The closure which is thus described in Perkins is a two-piece construction requiring separate manufacturing operations to create and form the ring as distint from the plunger.

Of course, one-piece plungers are known. An example of a cardboard tube employing a generally cup-shaped plunger is shown in Berg U.S. Pat. No. 3,319,841 issued May 16, 1967, in which a stamped cup of sheet metal forms the plunger. Berg does not disclose a plunger which also forms an integral rim which is crimped or which may be crimped to engage the lip or terminal end of the cardboard tube or container.

The patent of Sabaka No. 3,162,337, issued Dec. 22, 1964 shows another form of a caulking gun plunger which may be formed with a skirt having a depth in the range of ¼ inch to ¾ inches. Again, there is no disclosure or suggestion in Sabaka of incorporating such a plunger initially as an integral portion or part of a retainer or closure ring to effectively seal the cartridge prior to use. See also U.S. Pat. No. 3,211,347 to Phillips.

The problem with such one piece plungers is that they are generally not capable of long term protection of the fluid material in the caulking tube from spoilage (curing, drying, coagulating, etc.) due to air or moisture contact. The seal between the one-piece plunger and the wall of the tube while sufficient for the most part to prevent leakage of the fluid material from the containers, is not sufficient to prevent air and moisture contact over a period of time. In addition, temperature variations can lead to increased air an moisture exposure during storage of this type of caulking tube.

Accordingly, the need exists for a combined caulking tube plunger and enclosure which is capable of providing an air tight seal and yet easily separated to produce a break-away plunger, but which is easy to produce and apply to the caulking tube.

SUMMARY OF THE INVENTION

The present invention is directed primarily to the construction of a one-piece enclosure and plunger assembly for use with caulking tubes or the like in which a closure rim proportioned to engage the terminal end of the tube is integrally formed with a break-away plunger portion. A circumferential score line is formed in the body of the assembly inwardly of the rim portion which is readily separated by the application of force by the plunger ram thus to separate a plunger portion from the rim portion. In the preferred embodiment, the body of the plunger and enclosure assembly is provided with an inwardly curved rib positioned axially inwardly of a rim, and a dart or score is formed by use of a progressive cutting die to form a tear section at a point of high stress in the wall of the metal which results in a plunger portion of the assembly being readily separated from a rim portion when the caulking gun ram is applied to the bottom wall of the assembly and force is applied thereto.

The plunger and enclosure assembly is preferably made of an approximately 0.006–0.012 inch thick metal, such as tin plate or tin free steel; although, other ferrous or nonferrous metals may also be used. The cup-shaped plunger portion is deep drawn to a depth of between 0.5–1 inch.

The outside circular wall of the plunger portion is adapted to fit closely with the inside diameter of a caulking tube to produce fluid tight fit. The tube may be of a typical fiberboard tubular construction having a spout at one end thereof. The tube may also be lined with an air impervious foil so that when the plunger and enclosure assembly is applied to the open end of the filled tube, and the rim rolled over and sealed to the tube, an air tight closure is produced.

It is accordingly an important object of this invention to provide a one-piece plunger and enclosure assembly for a caulking tube which incorporates an integral rim which may be curved or crimped over the terminal end of the tube for positively sealing the tube from leakage, incorporating a break-away score line circumferentially thereabout for separating a plunger portion of the closure member from the rim.

A further object of the invention is a provision of a drawn cup-shaped sheet metal closure for a caulking tube or the like forming an integral plunger portion and rim portion joined by a break away or scored portion for separation. These and other objects and advantages of the invention will be apparent from the following description, the accompanying drawings and the appended claims.

DETAILED DESCRIPTION OF THE PREFERRED EMBODIMENTS

Figure 1:
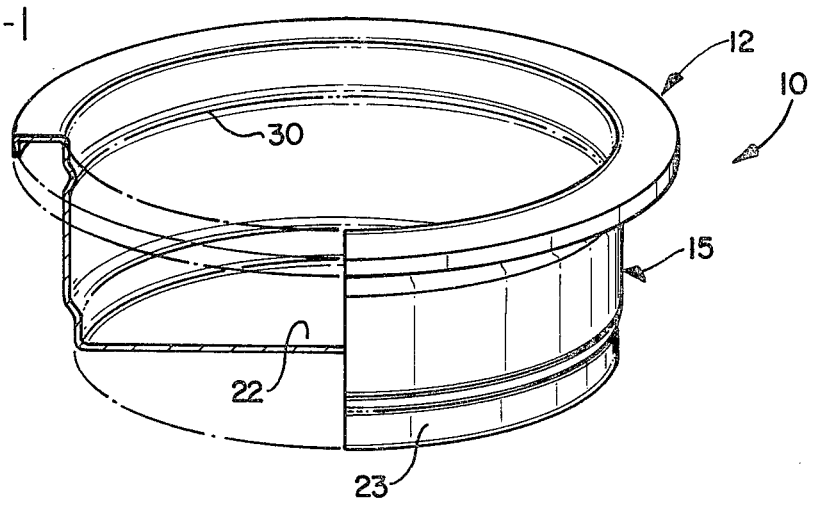
FIG. 1 is a perspective view, partially broken away, of the combined caulking tube plunger and enclosure assembly of this invention.
Figure 2:
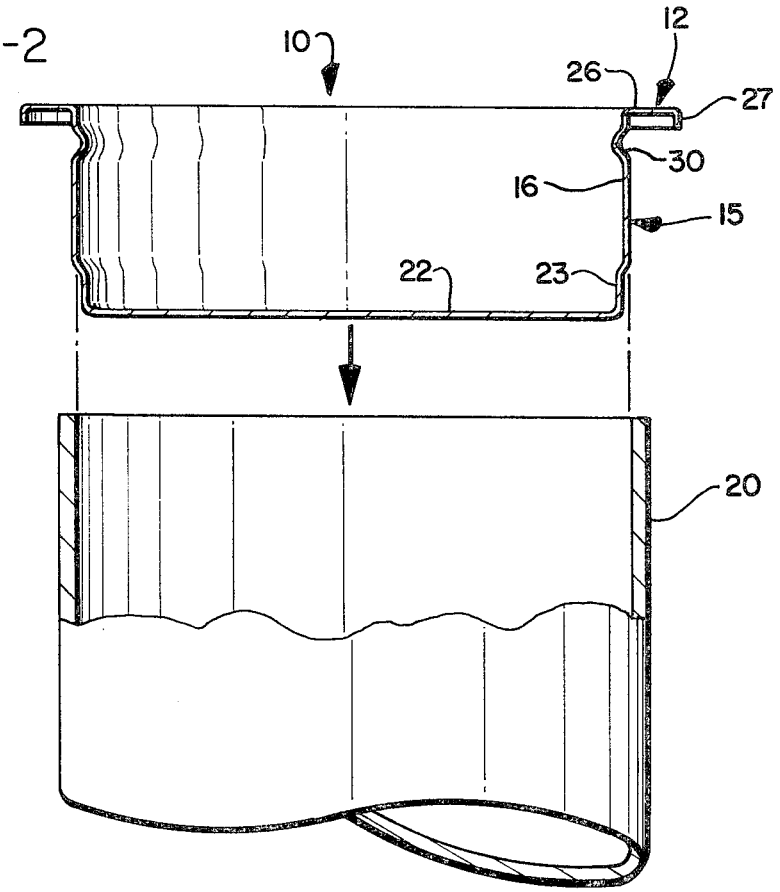
FIG. 2 is a view showing a vertical section of the assembly prior to being inserted within the terminal end of the caulking tube.
Figure 4:
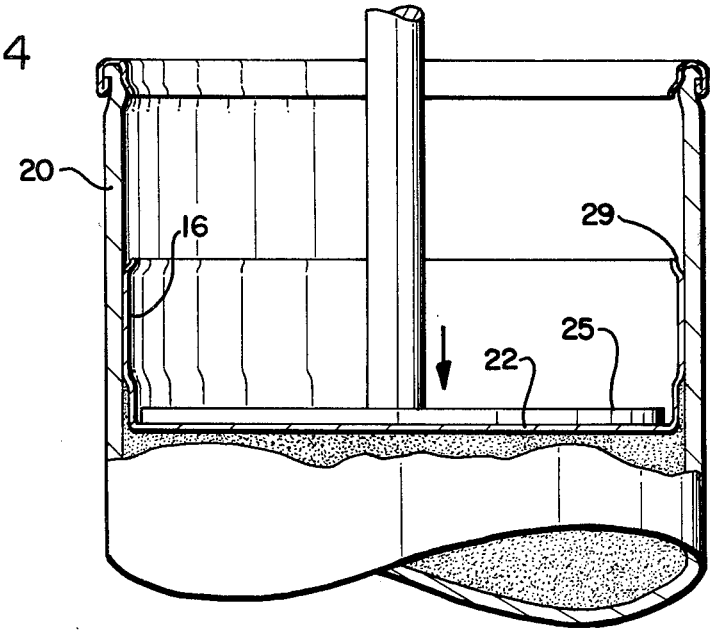
FIG. 4 is a view similar to FIG. 3 showing the manner in which the plunger portion moves through the tube after it has been separated from the rim portion, by the application of force of a caulking gun ram.

A drawn metal generally cup-shaped combined caulking tube plunger and enclosure assembly is illustrated generally at 10 in FIG. 1. Assembly 10 is formed of sheet metal, which may be a tin coated ferrous material, tin free steel, or a nonferrous material such as aluminum. The body of the assembly 10 is preferably formed substantially of uniform thickness material throughout and may vary from six to twelve thousandths in thickness, depending upon the material used. For a tin plate, a ten thousands thickness is most preferred. The drawn metal generally cup-shaped body of the combined plunger and enclosure is formed with a rim portion illustrated generally at 12 and a depending plunger portion illustrated generally at 15. The plunger portion 15 is formed with an annular or circular side wall 16 proportioned to extend within the interior of a caulking tube 20 and is formed with a generally flat bottom wall 22 adapted to be engaged by the ram 25, as illustrated in FIG. 4.

The rim portion 12 of the assembly 10 is provided with an outwardly extending rim or section 26 terminating in a downwardly turned end 27, prior to being fitted onto the tube 20. Immediately inwardly of the rim 26 there is preferably provided an annular inwardly formed rib 30 adjacent the rim 26 and formed in the side wall 16. The axially depth of the side wall 16 may vary considerably but is preferably in the order of ½ to 1 inch thus to provide a cup depth and a circumferential wall which is sufficient to provide guidance for movement of the plunger portion 15 through the tube 20.

Figure 5:
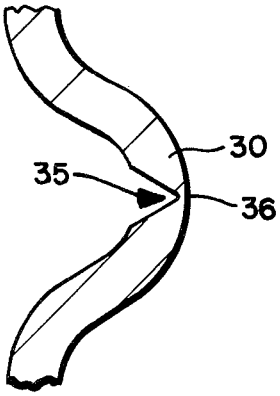
FIG. 5 is an enlarged fragmentary section through the rib showing the score.

The plunger portion 15 is joined with a rim portion 12 by means of a narrow wall section defined by an annular or circumferential inwardly extending cut or score 35 as best seen in FIG. 5. The break-away score 35 is thus formed as an incised portion in the outer wall of the rib 30 and separates by tearing when an axial force is applied by the ram 25. While the employment of a rib 30 is preferred, particularly in ferrous materials, it is understood that it is within the scope of this invention to eliminate the rib and to form the break away score 35 directly in the wall 16, without the use of the rib. The rib 30, however, aids or assists in the break away action as the rib tends to straighten or flaten upon the application of a break away force by the ram 25 and such straightening action provides high momentary stress at the narrow web 36 of material underlying the score 35 which stress rapidly exceeds the tear strength of the metal thus to separate the ram portion 15 from the rim portion 12.

Figure 3:
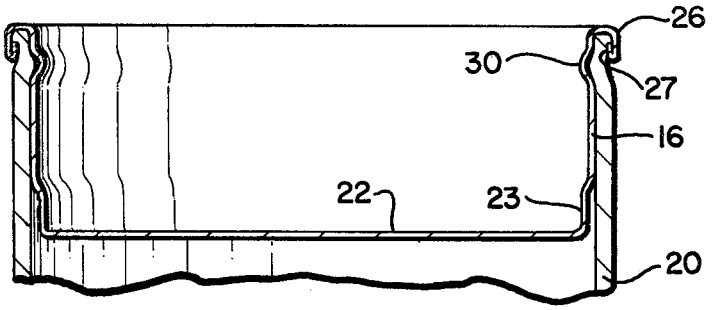
FIG. 3 is a sectional view showing the assembly in place after the rim has been crimped and rolled tightly about the terminal end of the tube to form a fluid tight closure.

When the assembly 10 of this invention is applied to a filled caulking tube, the rim portion 12 is crimped by bringing the downwardly extending ledge 27 around and against the adjacent surface of the radially directed rim portion 26 and is rolled in place tightly crimping the terminal end of the tube 20 between the rim and the adjacent inner wall 16, forming a fluid tight closure as illustrated in FIG. 3. Indent 23 may be used to help lead the assembly 10 into the end of tube 20 and it also makes the undividual assemblies nestable for storage prior to use. Since the assembly 10 is formed of a single piece of metal, there is no chance of leakage or dripping from the caulking tube. Likewise, if the caulking tube is lined with an air impervious material (foil), as is usual, the closure will also be air tight. When a force is applied by the plunger 25, the plunger portion 15 is readily separated from the rim portion 12 and moves as a plunger entity through the tube, as illustrated in FIG. 4.

An additional advantage of the present invention is that when the score 35 is placed as shown in FIG. 5, and following separation, edge 29 (see FIG. 4) of the plunger portion will be slightly spaced from contact with the wall of tube 20. Since the edge 29 is sharp, it would otherwise scrape the wall of tube 20 and prevent backing off of the plunger. Of course, when that feature is desired (to prevent displacement of the plunger—see Berg U.S. Pat. No. 3,319,841), it is possible to locate the score 35 so that an engaging edge is created. Other positions for score 35 may also be used.

While the form of apparatus herein described constitutes a preferred embodiment of the invention, it is to be understood that the invention is not limited to this precise form of apparatus, and that changes may be made therein without departing from the scope of the invention.

What is claimed is:

1. A combined caulking tube plunger and enclosure assembly comprising:

a drawn metal generally cup-shaped body having a bottom wall, a circular side wall adapted to form a close fit with the inside diameter of a caulking tube, an outer rim proportioned to be rolled over an end of the tube forming a seal therewith, means in said side wall defining an inwardly directed annular rib positioned inwardly of said rim, and a circumferential break-away score, formed as an incised portion in the outer wall of said rib, which is severable upon the application of a force to said bottom wall by a caulking gun ram to separate said bottom wall from said rim thereby forming a caulking tube plunger, whereby the separating forces applied by said caulking gun ram to said bottom wall tend to straighten said rib thereby opening the incised portion and concentrating the tearing forces to the metal of said wall immediately underlying said incised portion.

2. The combined caulking tube plunger and enclosure assembly of claim 1 wherein said metal generally cup-shaped body is approximately 0.006–0.012 inch thick.

3. The combined caulking tube plunger and enclosure assembly of claim 2 wherein said metal generally cup-shaped body has a depth of approximately 0.5–1 inch as measured from said bottom wall to said rim.

4. The combined caulking tube plunger and enclosure assembly of claim 3 wherein said metal generally cup-shaped body is approximately 0.010 inch thick tin plate.

5. In a caulking tube having:

a fiberboard tubular body having two ends, and a spout located at one end of said tubular body, the improvement comprising:

a plunger and enclosure assembly located at the other end of said tubular body, said plunger and enclosure assembly having a drawn metal generally cup-shaped body with a bottom wall, a circular side wall forming a close fit with the inside diameter of said tubular body, an outer rim rolled over the end of said tubular body to form a seal therewith, means in said side wall defining an inwardly directed annular rib positioned inwardly of said rim, and a circumferential break away score formed as an incised portion in the outer wall of said rib, which is severable upon the application of a force to said bottom wall by a caulking gun ram to separate said bottom wall and the major portion of said side wall from said rim thereby forming a plunger for said caulking tube, whereby the separating forces applied by said caulking gun ram to said bottom wall tend to straighten said rib thereby opening the incised portion and concentrating the tearing forces to the metal of said wall immediately underlying said incised portion.

* * * * *